US011610745B1

(12) United States Patent
Chang et al.

(10) Patent No.: US 11,610,745 B1
(45) Date of Patent: Mar. 21, 2023

(54) KEY STRUCTURE

(71) Applicant: Primax Electronics Ltd., Taipei (TW)

(72) Inventors: Sheng-Fan Chang, Taipei (TW); Lei-Lung Tsai, Taipei (TW); Chin-Sung Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/586,974

(22) Filed: Jan. 28, 2022

(30) Foreign Application Priority Data

Dec. 23, 2021 (TW) ..... 110148473

(51) Int. Cl.
*H01H 13/14* (2006.01)
*H01H 13/10* (2006.01)

(52) U.S. Cl.
CPC ..... *H01H 13/14* (2013.01); *H01H 13/10* (2013.01); *H01H 2233/07* (2013.01)

(58) Field of Classification Search
CPC .... H01H 13/14; H01H 13/10; H01H 2233/07; H01H 3/12; H01H 13/50; H01H 13/52; H01H 13/70; H01H 2233/072; H01H 2233/074; H01H 2233/076; H01H 2233/078; H01H 2233/086; H01H 2221/024
See application file for complete search history.

(56) References Cited

U.S. PATENT DOCUMENTS 6,242,705 B1 * 6/2001 Huang ..... H01H 13/705 200/341
7,402,765 B2 * 7/2008 Yu ..... H01H 13/705 200/341

* cited by examiner

*Primary Examiner* — Lheiren Mae A Caroc
(74) *Attorney, Agent, or Firm* — Kirton McConkie; Evan R. Witt

(57) ABSTRACT

A key structure includes a base plate, a switch element, a key pedestal and a keycap. The key pedestal includes an opening, a first hooking structure and a second hooking structure. The keycap includes an edge part, a triggering post, a third hooking structure and a fourth hooking structure. The third hooking structure and the fourth hooking structure are installed on the edge part. The switch element is installed on the base plate. The key pedestal is installed on the base plate. The triggering post is inserted into the opening to trigger the switch element. The third hooking structure of the keycap is movably connected with the first hooking structure of the key pedestal. The fourth hooking structure of the keycap is movably connected with the second hooking structure of the key pedestal. Consequently, the keycap is maintained in a horizontal state and not tilted.

9 Claims, 4 Drawing Sheets

KEY STRUCTURE

FIELD OF THE INVENTION

The present invention relates to an input device, and more particularly to a key structure.

BACKGROUND OF THE INVENTION

Generally, a key structure comprises a keycap, a support element, a switch element and a base plate. The keycap of the key structure can be ascended by the support element for a certain height with respect to the base plate. This height is related to a press stroke of the key structure. When the keycap is pressed by the user, the keycap is moved downwardly along the height, and thus the switch element is trigged to generate a key signal. When the keycap is no longer pressed, the keycap is moved upwardly and returned to its original position along this height. Generally, the switch element of the key structure is located under the center position of the keycap. After the key structure is pressed down, the switch element can be triggered to generate the key signal. Generally, the connecting structure and the support element are located at the nearby position corresponding to the center of the keycap. In other words, the position under the peripheral area of the keycap is not well supported.

However, the position under the peripheral area of the keycap is not well supported. Consequently, when the key structure is pressed down, some drawbacks occur. For example, if the pressed position is close to the peripheral area of the keycap, the keycap is readily rocked and unstably moved, or the region of the keycap opposite to the pressed position is upturned and the keycap is tilted. If the keycap is pressed frequently, the force-bearing area of the keycap is shifted. Moreover, if the force-exerting position is inaccurate or the force is improperly applied, the keycap is possibly subjected to deformation, or the support element is damaged. Moreover, the press sensitivity of the keycap is possibly deteriorated.

SUMMARY OF THE INVENTION

For solving the drawbacks of the conventional technologies, the present invention provides a key structure. The key structure includes a keycap and a key pedestal. The keycap comprises plural keycap hooks. The keycap hooks are installed on the edge corners of the keycap or installed on the peripheral area of the keycap. The key pedestal comprises plural pedestal hooks. The pedestal hooks are aligned with the edge corners of the keycap. The pedestal hooks are connected with the corresponding keycap hooks. Due to the arrangement of the keycap hooks and the pedestal hooks, the edge corners of the keycap can be effectively supported, and the keycap can be maintained in the horizontal state and not tilted. When the key structure is pressed down, the keycap can be stably moved and not rocked or upturned. In addition, the press sensitivity of the keycap is enhanced.

In accordance with an aspect of the present invention, a key structure is provided. The key structure includes a base plate, a switch element, a key pedestal and a keycap. The switch element is installed on the base plate. The key pedestal is installed on the base plate. The switch element is covered by the key pedestal. The key pedestal includes an opening, a first hooking structure and a second hooking structure. The keycap is located over the key pedestal to cover the key pedestal. The keycap includes an edge part, a triggering post, a third hooking structure and a fourth hooking structure. The third hooking structure and the fourth hooking structure are installed on the edge part and arranged around the triggering post. The triggering post is inserted into the opening of the key pedestal and aligned with the switch element. The first hooking structure and the second hooking structure of the key pedestal are aligned with the edge part of the keycap. The third hooking structure of the keycap is movably connected with the first hooking structure of the key pedestal. The fourth hooking structure of the keycap is movably connected with the second hooking structure of the key pedestal. Consequently, the keycap is stably assembly with the key pedestal and the keycap is maintained in a horizontal state and not tilted.

In an embodiment, the keycap further includes an outer wall, and the outer wall is located at the edge part of the keycap. The third hooking structure and the fourth hooking structure of the keycap are installed on the outer wall. The third hooking structure and the fourth hooking structure are extended from the outer wall in a direction toward the key pedestal.

In an embodiment, the first hooking structure and the second hooking structure of the key pedestal are aligned with the outer wall of the keycap. The first hooking structure and the second hooking structure are extended in a direction toward the outer wall.

In an embodiment, the first hooking structure and the second hooking structure of the key pedestal are arranged around the opening of the key pedestal.

In an embodiment, the first hooking structure of the key pedestal includes a first inner hook, a second inner hook, a third inner hook and a fourth inner hook. The first inner hook, the second inner hook, the third inner hook and the fourth inner hook are located at a periphery of the opening of the key pedestal and arranged around the opening. The first inner hook and the second inner hook are in parallel with each other. The third inner hook and the fourth inner hook are in parallel with each other.

In an embodiment, the second hooking structure of the key pedestal includes a first outer hook, a second outer hook, a third outer hook and a fourth outer hook. The first outer hook, the second outer hook, the third outer hook and the fourth outer hook are located at a periphery of the opening of the key pedestal and arranged around the opening. The first outer hook and the second outer hook are in parallel with each other. The third outer hook and the fourth outer hook are in parallel with each other.

In an embodiment, the third hooking structure of the keycap includes a first side hook, a second side hook, a third side hook and a fourth side hook. The first side hook, the second side hook, the third side hook and the fourth side hook are installed on the edge part of the keycap. The first side hook and the second side hook are in parallel with each other. The third side hook and the fourth side hook are in parallel with each other.

In an embodiment, the fourth hooking structure of the keycap includes a first corner hook, a second corner hook, a third corner hook and a fourth corner hook. The first corner hook, the second corner hook, the third corner hook and the fourth corner hook are installed on the edge part of the keycap. The first corner hook and the second corner hook are in parallel with each other. The third corner hook and the fourth corner hook are in parallel with each other.

In an embodiment, the keycap further includes a center part, and the edge part of the keycap is arranged around the center part. The triggering post of the keycap is installed on the center part. The opening of the key pedestal is aligned with the center part.

In an embodiment, the keycap further includes a positioning post, and the key pedestal further includes a positioning recess. The positioning post of the keycap is inserted into the positioning recess of the key pedestal. Consequently, the keycap is positioned on the key pedestal.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
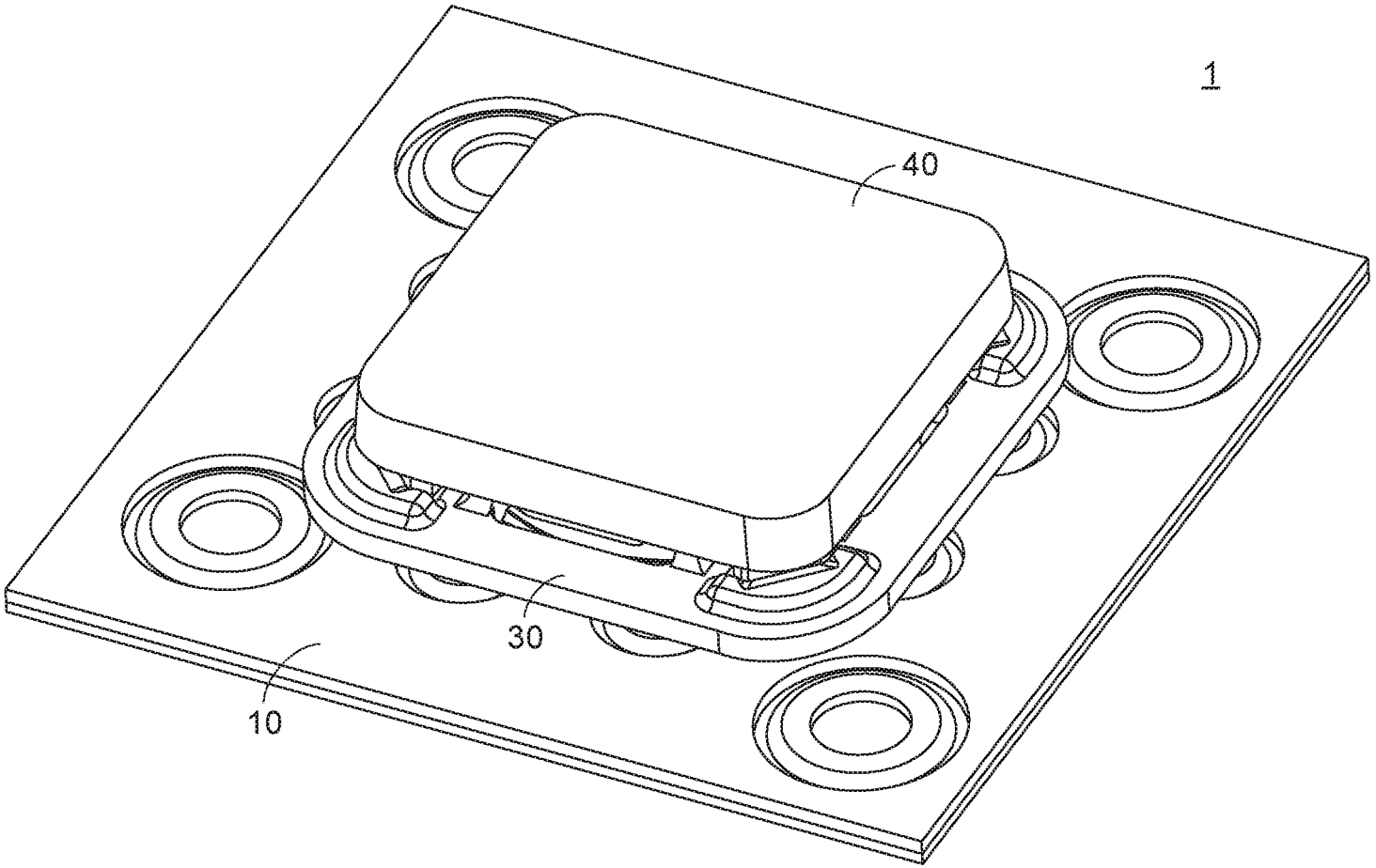
FIG. 1 is a schematic perspective view illustrating a key structure according to an embodiment of the present invention.
Figure 2:
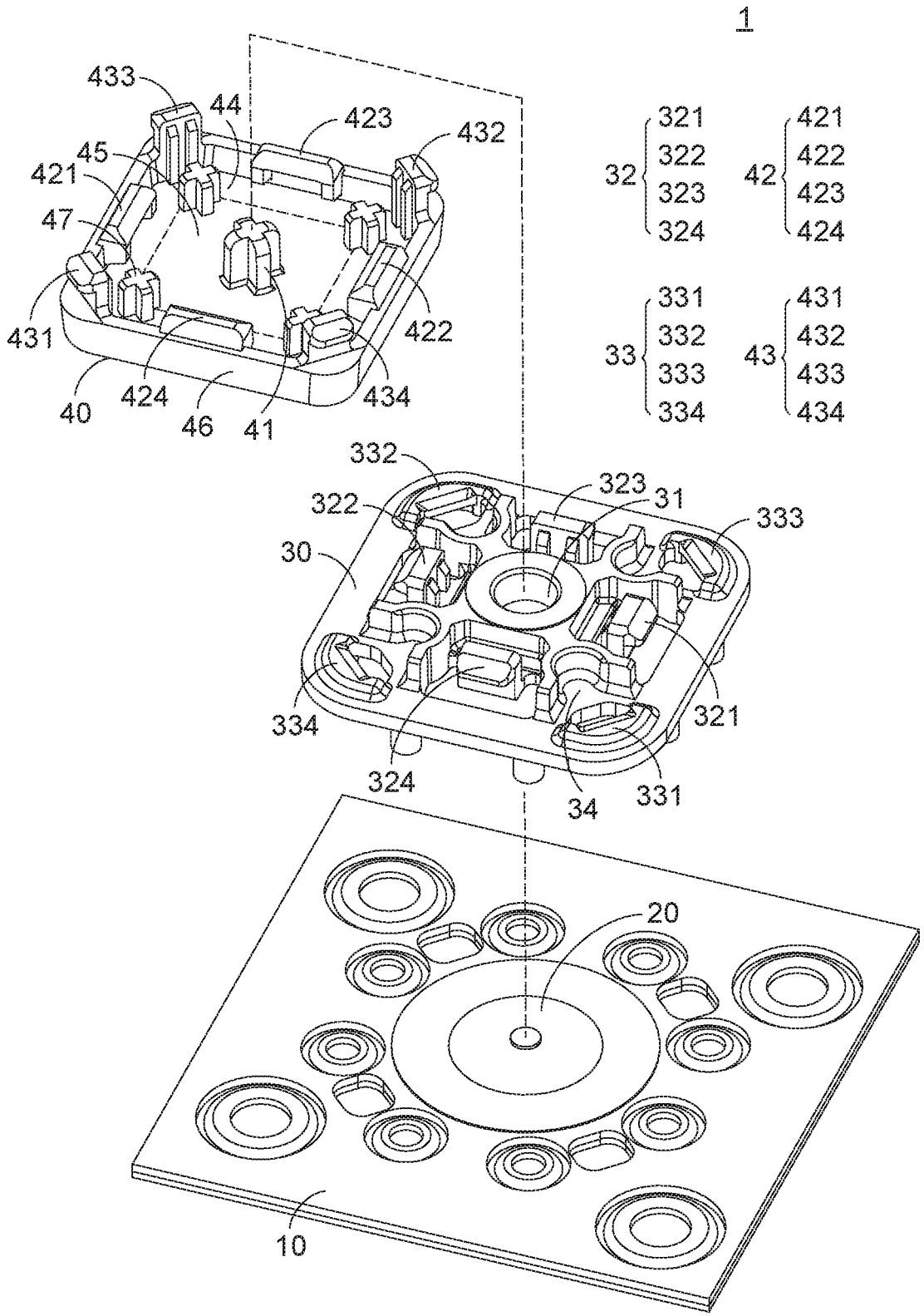
FIG. 2 is a schematic exploded view illustrating the key structure as shown in FIG. 1.

FIG. 1 is a schematic perspective view illustrating a key structure according to an embodiment of the present invention. FIG. 2 is a schematic exploded view illustrating the key structure as shown in FIG. 1. As shown in FIGS. 1 and 2, the key structure 1 comprises a base plate 10, a switch element 20, a key pedestal 30 and a keycap 40.

The key pedestal 30 comprises an opening 31, a first hooking structure 32 and a second hooking structure 33. The first hooking structure 32 and the second hooking structure 33 of the key pedestal 30 are arranged around the opening 31 of the key pedestal 30. The keycap 40 comprises a triggering post 41, a third hooking structure 42, a fourth hooking structure 43, an edge part 44 and a center part 45. The edge part 44 of the keycap 40 is arranged around the center part 45 of the keycap 40. The edge part 44 is located at a peripheral area of the keycap 40. The triggering post 41 is installed on the center part 45. The third hooking structure 42 and the fourth hooking structure 43 are installed on the edge part 44 of the keycap 40 and arranged around the triggering post 41.

The switch element 20 is installed on the base plate 10. The key pedestal 30 is fixed on the base plate 10. In addition, the switch element 20 is covered by the key pedestal 30. The top side of the key pedestal 30 is covered by the keycap 40. The triggering post 41 of the keycap 40 is inserted into the opening 31 of the key pedestal 30. In addition, the triggering post 41 of the keycap 40 is aligned with the switch element 20. The first hooking structure 32 and the second hooking structure 33 of the key pedestal 30 are aligned with the edge part 44 of the keycap 40. The third hooking structure 42 of the keycap 40 is movably connected with the first hooking structure 32 of the key pedestal 30. The fourth hooking structure 43 of the keycap 40 is movably connected with the second hooking structure 33 of the key pedestal 30. Since the keycap 40 is stably assembly with the key pedestal 30, the keycap 40 is maintained in the horizontal state and not tilted.

The keycap 40 further comprises an outer wall 46. The outer wall 46 is located at the edge part 44 of the keycap 40. The third hooking structure 42 and the fourth hooking structure 43 are installed on the outer wall 46 of the keycap 40. The third hooking structure 42 and the fourth hooking structure 43 are extended from the outer wall 46 of the keycap 40 in the direction toward the key pedestal 30. The first hooking structure 32 and the second hooking structure 33 of the key pedestal 30 are aligned with the outer wall 46. In addition, the first hooking structure 32 and the second hooking structure 33 of the key pedestal 30 are extended in the direction toward the keycap 40. The first hooking structure 32 of the key pedestal 30 is engaged with the third hooking structure 42 of the keycap 40. The second hooking structure 33 of the key pedestal 30 is engaged with the fourth hooking structure 43 of the keycap 40.

Figure 3:
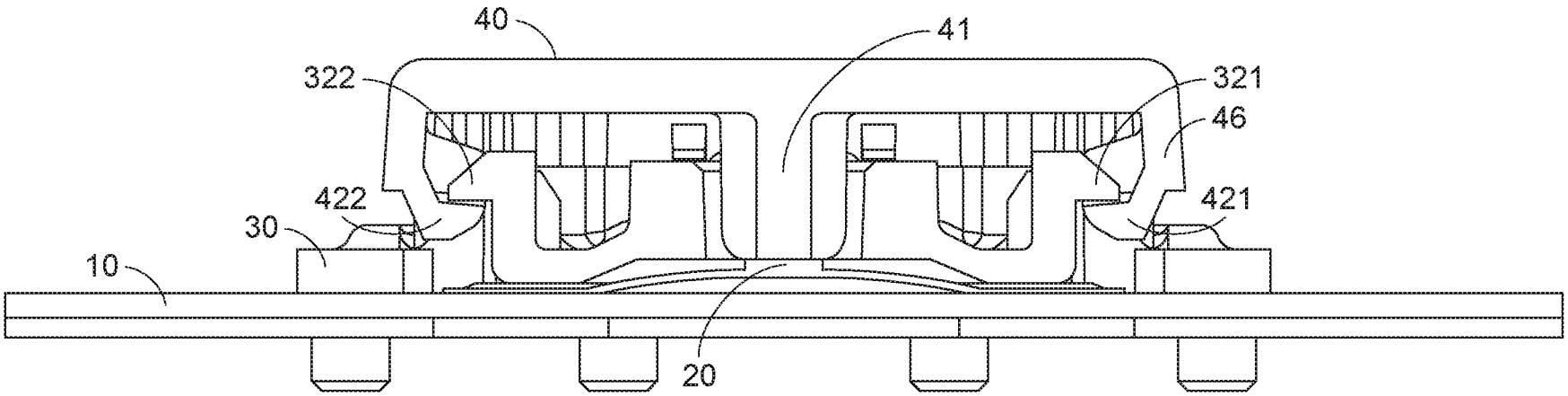
FIG. 3 is a schematic cross-sectional view illustrating the key structure according to the embodiment of the present invention.
Figure 4:
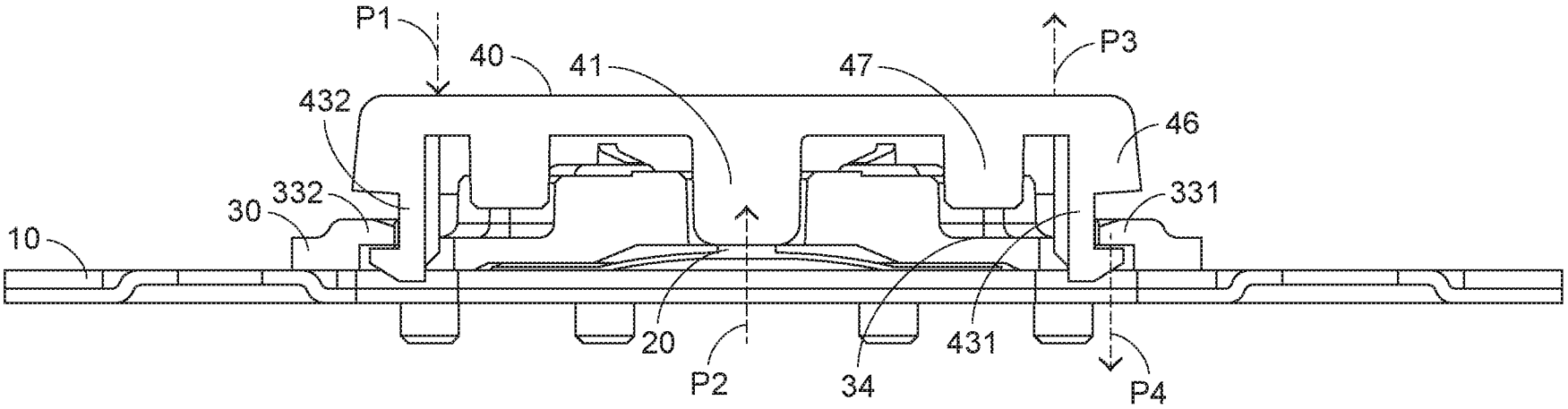
FIG. 4 is a schematic cross-sectional view illustrating the key structure according to the embodiment of the present invention and taken along another viewpoint.

Please refer to FIGS. 2, 3 and 4. FIG. 3 is a schematic cross-sectional view illustrating the key structure according to the embodiment of the present invention. FIG. 4 is a schematic cross-sectional view illustrating the key structure according to the embodiment of the present invention and taken along another viewpoint.

The keycap 40 of the key structure 1 has a rectangular or parallelogram structure. As known, the rectangular or parallelogram structure has four sides and four corners. The four sides are divided into two groups of opposite side. The two opposite sides of the same group are aligned with each other and in parallel with each other. The four corners are divided into two groups of across corners. The two across corners of the same group are aligned with each other and in parallel with each other. The third hooking structure 42 of the keycap 40 is located at the four sides of the keycap 40. The fourth hooking structure 43 of the keycap 40 is located at the four corners of the keycap 40. The positions of the first hooking structure 32 and the second hooking structure 33 of the key pedestal 30 correspond to the positions of the third hooking structure 42 and the fourth hooking structure 43 of the keycap 40, respectively. In other words, the installation position of the first hooking structure 32 of the key pedestal 30 corresponds to the four sides of the keycap 40, and the installation position of the second hooking structure 33 of the key pedestal 30 corresponds to four corners of the keycap 40.

In an embodiment, the first hooking structure 32 of the key pedestal 30 comprises a first inner hook 321, a second inner hook 322, a third inner hook 323 and a fourth inner hook 324. These four inner hooks 321, 322, 323 and 324 are aligned with the four sides of the keycap 40, respectively. The first inner hook 321, the second inner hook 322, the third inner hook 323 and the fourth inner hook 324 of the first hooking structure 32 are located at the periphery of the opening 31 of the key pedestal 30 and arranged around the opening 31. The first inner hook 321 and the second inner hook 322 are in parallel with each other. The third inner hook 323 and the fourth inner hook 324 are in parallel with each other.

In an embodiment, the second hooking structure 33 of the key pedestal 30 comprises a first outer hook 331, a second outer hook 332, a third outer hook 333 and a fourth outer hook 334. These four outer hooks 331, 332, 333 and 334 are aligned with the four corners of the keycap 40, respectively. The first outer hook 331, the second outer hook 332, the third outer hook 333 and the fourth outer hook 334 of the second hooking structure 33 are located at the periphery of the opening 31 of the key pedestal 30 and arranged around the opening 31. The first outer hook 331 and the second outer hook 332 are in parallel with each other. The third outer hook 333 and the fourth outer hook 334 are in parallel with each other.

In an embodiment, the third hooking structure 42 of the keycap 40 comprises a first side hook 421, a second side hook 422, a third side hook 423 and a fourth side hook 424. These four side hooks 421, 422, 423 and 424 are installed on the four sides of the keycap 40, respectively. Moreover, the first side hook 421, the second side hook 422, the third side hook 423 and the fourth side hook 424 are installed on the edge part 44 of the keycap 40. Preferably, these four side hooks 421, 422, 423 and 424 are installed on the outer wall 46 of the keycap 40. The first side hook 421 and the second side hook 422 are in parallel with each other. The third side hook 423 and the fourth side hook 424 are in parallel with each other.

In an embodiment, the fourth hooking structure 43 of the keycap 40 comprises a first corner hook 431, a second corner hook 432, a third corner hook 433 and a fourth corner hook 434. These four corner hooks 431, 432, 433 and 434 are installed on the four corners of the keycap 40, respectively. The first corner hook 431, the second corner hook 432, the third corner hook 433 and the fourth corner hook 434 are also installed on the edge part 44 of the keycap 40. Preferably, these four corner hooks 431, 432, 433 and 434 are installed on the outer wall 46 of the keycap 40. The first corner hook 431 and the second corner hook 432 are in parallel with each other. The third corner hook 433 and the fourth corner hook 434 are in parallel with each other.

As mentioned above, the first side hook 421 of the third hooking structure 42 of the keycap 40 is aligned with and movably connected with the first inner hook 321 of the first hooking structure 32 of the key pedestal 30. Similarly, the second side hook 422 is aligned with and movably connected with the second inner hook 322. Similarly, the third side hook 423 is aligned with and movably connected with the third inner hook 323. Similarly, the fourth side hook 424 is aligned with and movably connected with the fourth inner hook 324.

The first corner hook 431 of the fourth hooking structure 43 of the keycap 40 is movably connected with the first outer hook 331 of the second hooking structure 33 of the key pedestal 30. Similarly, the second corner hook 432 is aligned with and movably connected with the second outer hook 332. Similarly, the third corner hook 433 is aligned with and movably connected with the third outer hook 333. Similarly, the fourth corner hook 434 is aligned with and movably connected with the fourth outer hook 334.

Hereinafter, the detailed structure of the keycap 40 and the detailed structure of the key pedestal 30 will be described with reference to FIGS. 3 and 4.

As shown in FIG. 3, the first side hook 421 of the third hooking structure 42 of the keycap 40 is movably connected with the first inner hook 321 of the key pedestal 30, and the second side hook 422 of the keycap 40 is movably connected with the second inner hook 322 of the key pedestal 30. When the keycap 40 is installed on the key pedestal 30, the keycap 40 can be pressed and moved downwardly. As the keycap 40 is moved downwardly, the triggering post 41 is moved downwardly to trigger the switch element 20. Moreover, the schematic cross-sectional view of the key structure as shown in FIG. 4 is taken along a diagonal line of the keycap 40. As shown in FIG. 4, the first corner hook 431 of the keycap 40 is movably connected with the first outer hook 331 of the second hooking structure 33 of the key pedestal 30, and the second corner hook 432 is movably connected with the second outer hook 332. Consequently, the keycap 40 is connected with the key pedestal 30. Moreover, when the keycap 40 is pressed down, the triggering post 41 is moved downwardly to trigger the switch element 20.

In accordance with a feature of the present invention, the keycap 40 can be stably maintained in the horizontal state. The operating principles will be described as follows. When a first end of the peripheral area of the keycap 40 is pressed down, a pressing force in a pressing direction P1 is exerted on the keycap 40. Since the triggering post 41 and the switch element 20 are pushed against each other, a resisting force in a pushing direction P2 is exerted on the triggering post 41 by the switch element 20. Under this circumstance, the switch element 20 is used as a fulcrum. At the same time, a force in an upward direction P3 is generated at a second end of the keycap 40, which is opposed to the first end of the keycap 40. In other words, the second end of the keycap 40 is prone to be upturned, and the keycap 40 is prone to be tilted when the keycap 40 is pressed down. However, since the first outer hook 331 of the key pedestal 30 is engaged with the first corner hook 431 of the keycap 40, a force in a downward direction P4 is provided by the first corner hook 431. The force in the downward direction P4 can counteract the force in the upward direction P3. Consequently, the second end of the keycap 40 is not upturned, and the keycap 40 is not tilted when the keycap 40 is pressed down. Moreover, the downward force P4 provided by the first corner hook 431 can assist in the pressing action of the keycap 40. Consequently, when the keycap 40 is pressed down, the keycap 40 can be moved downwardly more easily in order to trigger the switch element 20.

Moreover, due to the arrangement of the first hooking structure 32 and the second hooking structure 33 on the key pedestal 30 and the arrangement of the third hooking structure 42 and the fourth hooking structure 43 on the keycap 40, the purposes of stabilizing the peripheral area of the keycap 40 and maintaining the keycap 40 in the horizontal state can be achieved.

In an embodiment, the keycap 40 further comprises at least one positioning post 47, and the key pedestal 30 further comprises at least one positioning recess 34. When the keycap 40 is assembled with the key pedestal 30, the positioning post 47 is inserted into the corresponding positioning recess 34. The engagement between the positioning post 47 and positioning recess 34 can facilitate aligning the keycap 40 with the key pedestal 30 and positioning the keycap 40 on the key pedestal 30.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base plate;

a switch element installed on the base plate;

a key pedestal installed on the base plate, wherein the switch element is covered by the key pedestal, and the key pedestal comprises an opening, a first hooking structure and a second hooking structure; and a keycap located over the key pedestal to cover the key pedestal, wherein the keycap comprises an edge part, a triggering post, a third hooking structure and a fourth hooking structure, wherein the third hooking structure and the fourth hooking structure are installed on the edge part and arranged around the triggering post, and the triggering post is inserted into the opening of the key pedestal and aligned with the switch element, wherein the first hooking structure and the second hooking structure of the key pedestal are aligned with the edge part of the keycap, the third hooking structure of the keycap is movably connected with the first hooking structure of the key pedestal, and the fourth hooking structure of the keycap is movably connected with the second hooking structure of the key pedestal, so that the keycap is stably assembled with the key pedestal and the keycap is maintained in a horizontal state and not tilted, wherein the first hooking structure of the key pedestal comprises a first inner hook, a second inner hook, a third inner hook and a fourth inner hook, wherein the first inner hook, the second inner hook, the third inner hook and the fourth inner hook are located at a periphery of the opening of the key pedestal and arranged around the opening, the first inner hook and the second inner hook are in parallel with each other, and the third inner hook and the fourth inner hook are in parallel with each other.

2. The key structure according to claim 1, wherein the keycap further comprises an outer wall, and the outer wall is located at the edge part of the keycap, wherein the third hooking structure and the fourth hooking structure of the keycap are installed on the outer wall, and the third hooking structure and the fourth hooking structure are extended from the outer wall in a direction toward the key pedestal.

3. The key structure according to claim 2, wherein the first hooking structure and the second hooking structure of the key pedestal are aligned with the outer wall of the keycap, and the first hooking structure and the second hooking structure are extended in a direction toward the outer wall.

4. The key structure according to claim 1, wherein the first hooking structure and the second hooking structure of the key pedestal are arranged around the opening of the key pedestal.

5. The key structure according to claim 1, wherein the second hooking structure of the key pedestal comprises a first outer hook, a second outer hook, a third outer hook and a fourth outer hook, wherein the first outer hook, the second outer hook, the third outer hook and the fourth outer hook are located at a periphery of the opening of the key pedestal and arranged around the opening, the first outer hook and the second outer hook are in parallel with each other, and the third outer hook and the fourth outer hook are in parallel with each other.

6. The key structure according to claim 1, wherein the third hooking structure of the keycap comprises a first side hook, a second side hook, a third side hook and a fourth side hook, wherein the first side hook, the second side hook, the third side hook and the fourth side hook are installed on the edge part of the keycap, the first side hook and the second side hook are in parallel with each other, and the third side hook and the fourth side hook are in parallel with each other.

7. The key structure according to claim 1, wherein the fourth hooking structure of the keycap comprises a first corner hook, a second corner hook, a third corner hook and a fourth corner hook, wherein the first corner hook, the second corner hook, the third corner hook and the fourth corner hook are installed on the edge part of the keycap, the first corner hook and the second corner hook are in parallel with each other, and the third corner hook and the fourth corner hook are in parallel with each other.

8. The key structure according to claim 1, wherein the keycap further comprises a center part, and the edge part of the keycap is arranged around the center part, wherein the triggering post of the keycap is installed on the center part, and the opening of the key pedestal is aligned with the center part.

9. The key structure according to claim 1, wherein the keycap further comprises a positioning post, and the key pedestal further comprises a positioning recess, wherein the positioning post of the keycap is inserted into the positioning recess of the key pedestal, so that the keycap is positioned on the key pedestal.

* * * * *